United States Patent [19]

Lesage

[11] 4,351,687

[45] Sep. 28, 1982

[54] MACHINE FOR COILING STRIP MATERIAL WITH A DEVICE FOR MOMENTARY IMMOBILIZATION OF THE TAILS OF THE STRIPS

[76] Inventor: Gaston Lesage, Cannettecourt BP 112, 60600 Clermont, France

[21] Appl. No.: 254,878

[22] Filed: Apr. 16, 1981

[30] Foreign Application Priority Data

Apr. 16, 1980 [FR] France ..... 80 08570

[51] Int. Cl.[3] ..... B65B 61/00

[52] U.S. Cl. ..... 156/353; 156/361; 156/446; 156/522; 242/56 R

[58] Field of Search ..... 156/357, 522, 446, 361, 156/353; 53/117-118; 242/57, 56

[56] References Cited

U.S. PATENT DOCUMENTS 3,869,845 3/1975 Rodach ..... 156/522 X 4,026,752 5/1977 Hartbauer ..... 156/357

*Primary Examiner*—David A. Simmons

*Attorney, Agent, or Firm*—Browdy and Neimark

[57] ABSTRACT

A machine for coiling material in strips is equipped with a device for immobilization of the strip tail at the end of a coiling phase. The immobilization device includes at least one support carrying a roll of adhesive tape and a pressing roller for pressing the tape onto the coil. Each support includes rollers for guiding and introducing the adhesive tape upon receipt of a signal from control unit, a tape cutting tool mounted on a jack which actuates the tape cutting tool upon passage of a preselected length of adhesive tape through the rollers, a magnet or suction cup for separating the tail from the coil, and a strip tail proximity detector which drives the rollers when the tail is detected.

10 Claims, 4 Drawing Figures

MACHINE FOR COILING STRIP MATERIAL WITH A DEVICE FOR MOMENTARY IMMOBILIZATION OF THE TAILS OF THE STRIPS

FIELD OF THE INVENTION

The present invention relates to a machine for coiling material in strips, especially sheet material, and more particularly such a machine equipped with means for momentary immobilization of the strip tail or tails, at the end of the coiling phase, so that the coil or coils can be removed to the manual or automatic packaging stations.

BACKGROUND OF THE INVENTION

Units of coiling material strips are currently found in steel mills, particularly in association with rolling equipment. Such units may involve only a single strip of relatively great width to be coiled or, when a machine for splitting already rolled sheet is present, they may involve the coiling about the same coiling shaft of several tight coils coming from the same mother strip cut lengthwise. As will be seen below, this second application raises particular problems that the present invention particularly proposes to solve.

In the known method, at the end of an operation of coiling one or more metal strips, an operator stops the machine and temporarily immobilizes the strip tail on the coil which has just been made, for example, by a piece of adhesive tape, to facilitate removal of the sheet coil to the packaging station. Even in the simplest case where a single strip is wound on the shaft of the machine, this operation represents considerable idle time in the use of the machine. In case the coiling occurs after splitting, this idle time is accompanied by a considerable waste of sheet at the end of the coiling. Actually, a mother strip at the output of the rolling does not have a constant thickness over its entire width. In brief, it is said that a rolled strip has "long edges" if the thicknesses at the edges are thinner than the thickness at the center and that it has a "long center" in the opposite case. Thus, strips cut from a mother strip with "long edges" and coiled on the same shaft of a coiling machine give rise to coils of different diameter that are greater in the middle of the coiling shaft than at its ends, an opposite situation being created by starting with a mother strip with a "long center". Under these conditions, from a given lengthy mother strip, the tails of the split strips will be in various positions in relation to one another at the end of the common coiling. To avoid having to immobilize the strip tails one after the other as they reach the coiling machine, by making the latter advance manually step by step, it is generally preferable to stop the machine when the first sheet tail reaches it and to cut all the other strips to the same length, at that time, to immobilize only one time the new strip tails thus created on their respective coils and then to unload the machine. This therefore involves a loss of a certain length of the split strip.

To momentarily immobilize the strip tails, there is known an adhesive tape device provided with supports that carry a roll of adhesive tape and a swinging roller intended to press the tape on a coil of strip material (U.S. Pat. No. 3,869,845). However, the means used in this device are not effective and do not make it possible to obtain successive automatic immobilizations of strip ends on industrial installations.

SUMMARY OF THE INVENTION

The present invention aims at avoiding these drawbacks. It proposes a machine having a distributor provided with supports carrying a roll of adhesive tape but with improved means of use.

According to the essential characteristics of the device according to the present invention, each support comprises: (a) means for guiding and introducing the adhesive tape between the pressing roll and the outside surface of the coil of strip material comprising a drive roller, stationary in relation to the support, and a pinching roller mounted on a jack fixed to the support and mobile in the direction of the drive roller, the drive roller and pinch roller being disposed on opposite sides of the path of the adhesive tape; (b) a tape-cutting tool mounted on a jack operated by an electrovalve driven by a counting unit assuring the preselection of lengths of adhesive tape as a function of the thicknesses of the split strips; (c) a means for separating the tail from the coil, comprising a magnet or a suction cup; and (d) a strip tail proximity detector connected to an electronic control unit.

BRIEF DESCRIPTION OF THE DRAWINGS

Other characteristics will come out from the following description of a preferred embodiment of a machine meeting the principles of the invention with reference to the accompanying diagrammatic drawings in which.

DETAILED DESCRIPTION OF A PREFERRED EMBODIMENT

Figure 1:
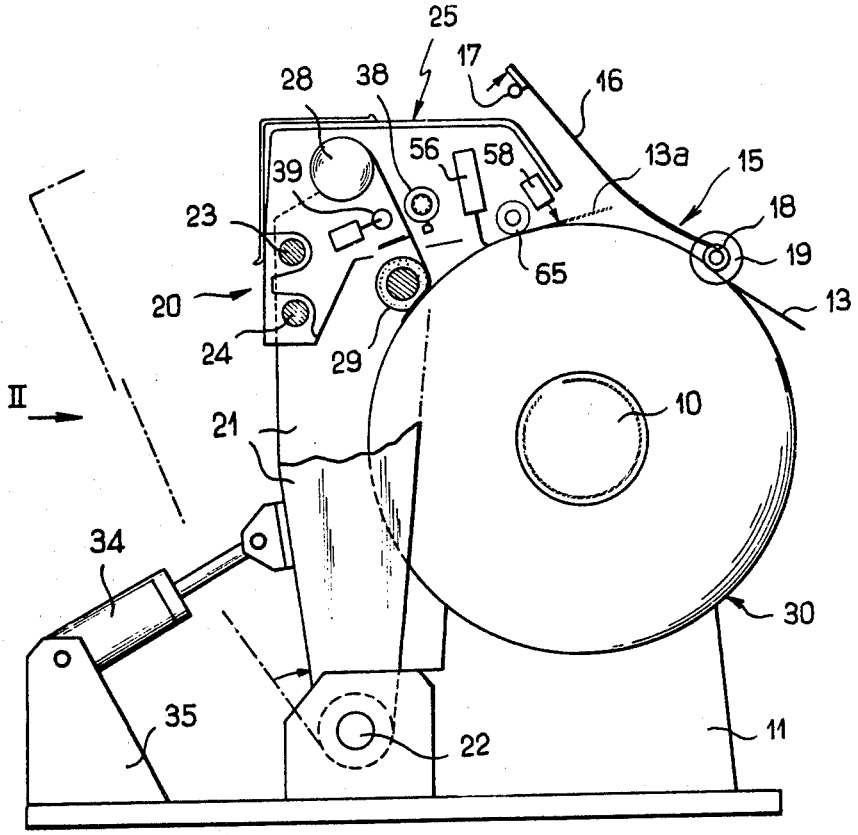
FIG. 1 is a diagrammatic view in elevation of a coiling machine provided with the improvements of the invention.

Referring to the drawings, there have been shown the standard elements of a coiling machine, namely, a shaft or mandrel 10 mounted offset in relation to a frame 11 protecting a reduction gear driven in rotation by a motor 12 and able to coil at least one strip of material such as a sheet 13 coming from another treating station (not shown). In case shaft 10 must coil several split strips from the same mother strip, there is provided a disk separator 15 (FIG. 1) made up of standards 16 pivoting around an axis 17 parallel to that of shaft 10 and supporting guide rollers 18, approximately the width of the strips, split and separated by disks 19 of larger diameter preventing striking between coils of neighboring split strips.

According to the present invention, this machine is equipped with an adhesive tape distributor 20 fairly mobile in the direction of shaft 10. More precisely, this distributor comprises two arms 21 pivoting around an axis 22. These arms are located in the vicinity of the ends of shaft 10 so as to carry between them two slide rods 23, 24 parallel to shaft 10 to be able to mount supports 25 and make possible their adjustable positioning in regard to shaft 10 by moving them along rods 23, 24. Each support 25 carries a roll of adhesive tape 28. On the other hand, distributor 20 comprises a pressing roll 29 able to come in contact with the outside surface of one or more coils 30 of material coiled around shaft 10. In the embodiment described, this pressing roller is common to all supports and is covered with a flexible elastic material 32, for example neoprene, making it possible to compensate for possible differences in diameter between several split coils simultaneously coiled on shaft 10. In practice, these differences in diameter can amount to several millimeters and elastic material 32 must be flexible and deformable for pressing roller 29 to rest effectively on all the coils when it occupies the position represented in FIG. 1. To do this, pressing roller 29 is mounted to rotate between pivoting arms 21 and the unit consisting of said arms 21, rods 23, 24, supports 25 and roller 29, can swing in the direction of coil or coils 30 (under the action of a jack mechanism 34 articulated between stationary frame 35 and a point of the unit defined above) until said pressing roller 29 comes to rest precisely against it or them.

Each support 25 carries, besides roll of adhesive tape 28, means for guiding and driving this adhesive tape, unwound from its roll, so as to introduce it between pressing roller 29 and the outside surface of coil 30 opposite which support 25 is positioned. These guiding and driving means are made up essentially, in the example described, of an arrangement of two rollers 38 and 39 arranged respectively on both sides of the unwinding path of adhesive tape 28*a*. Roller 38 is a drive roller whose axis of rotation, stationary in relation to support 25, comprises a fluted drive shaft 40 going through all the supports and mounted to rotate at its two ends, between the two pivoting arms 21. Fluted shaft 40, on the other hand, is coupled in rotation to pressing roller 29, for example by means of belt 42 mounted between the ends of roller 29 and shaft 40 in the vicinity of one of pivoting arms 21. Thus, each roller 38, which comprises a central bore also fluted, is fixed with respect to rotation with common shaft 40 but can move lengthwise along this shaft during positioning of corresponding support 25. A side flange 44, fastened to support 25, keeps roller 38 in good position on the support, i.e. opposite roller 39. Roller 39 is a pinching roller mobile in the direction of roller 38 because it is mounted to rotate freely at the end of a rod of a drive jack 46 fastened on support 25. The rod of jack 46 also carries a removal arm 47 able to engage adhesive tape 28*a* in a movement of withdrawal from the rod of jack 46 to separate said adhesive tape from roller 38. A cutting tool 48, able to cut adhesive tape 28*a* downstream from the two rollers 38, 39 and positioned in the vicinity of this unwinding path of said adhesive tape, is also mounted at the end of the rod of a drive jack 50 controlled by electrovalve 51 which is operated by an electronic counting unit 52 receiving at its input pulses generated by a turn counter 53 placed opposite roller 39. In brief, unit 52 is designed to generate an output order transmitted to electrovalve 51 when roller 39 has made a certain predetermined number of turns corresponding to unwinding of a certain length of adhesive tape.

Each support is also provided with an oil scraper 55 placed opposite coil 30 of the coiled material and also mounted at the end of the rod of drive jack 56 to be able to be moved in the direction of coil 30 and to bear against the latter to remove any trace of oil in the zone of coil 30 where the adhesive tape is to be applied. Jack 56 is itself supplied by an electrovalve 57 under a control order elaborated by proximity detector 58, known per se, positioned on support 25 to be located in the vicinity of the path of a strip tail of corresponding coil 30, when it reaches coil 30 at the end of coiling and when distributor 20 is in working position, i.e. with pressing roller 29 resting against all the coils 30. Detector 58 is sensitive only to the passage of strip tail 13*a* by the fact that, most often, it naturally straightens up in relation to the plane tangent to coil 30 and thus passes in the proximity of detector 58. The position of strip tail 13*a* has been shown in broken lines in FIG. 1, at its passage in the proximity of detector 58, which generates an output signal whose falling edge drives an electronic control unit 60, which drives electrovalve 62 (connection 61) controlling the introduction of the fluid in jack 46.

Figure 2:
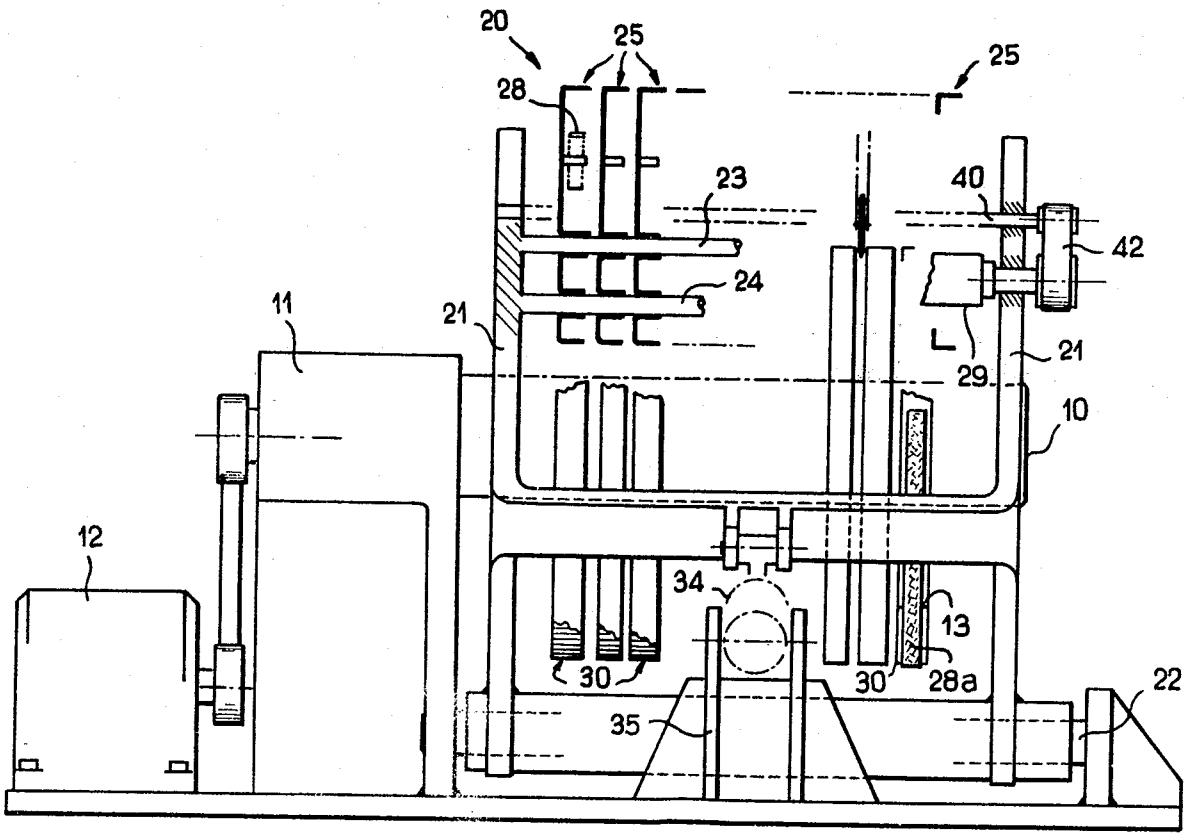
FIG. 2 is a view in partial section along arrow II of FIG. 1.
Figure 3:
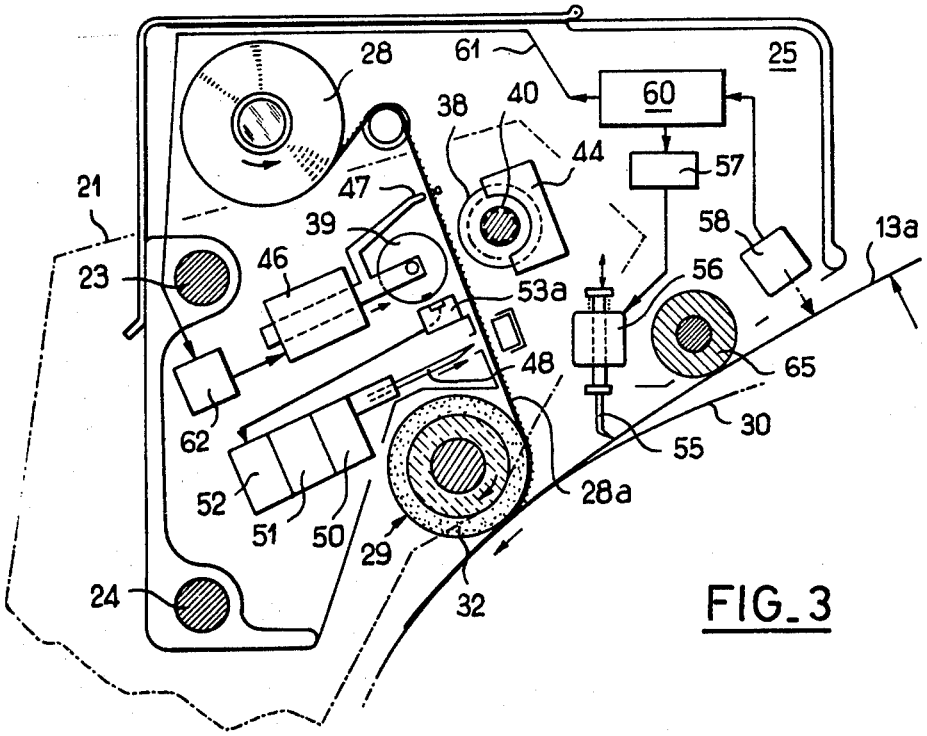
FIG. 3 is a more detailed view and on a larger scale of certain structural elements shown in FIG. 1.
Figure 4:
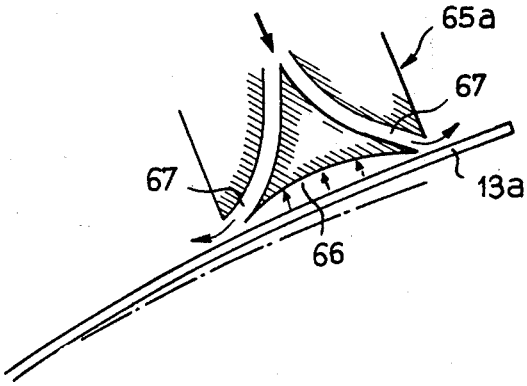
FIG. 4 is a diagrammatic view in section of a variant of devices equipping the machine of FIG. 1.

For materials of relatively slight thickness to be coiled, it can happen that strip tail 13*a* stays against the surface of coil 30, especially because of surface tension exerted by the lubricating oil that is on the strip. In this case, each support can include an attraction means 65 assuring separation of the strip tail 13*a* and consequently guaranteeing the good functioning of detector 58 which drives the entire automatic cycle of the adhesive strip distributor. In FIGS. 1 and 2, the attraction means is represented as being a magnet having the shape of an idle roller, which is suitable for all ferrous materials. On the other hand, when strip 13 is not made up of a material sensitive to magnetic attraction, this magnet can be replaced by an air film suction cup 65*a*, known per se, diagrammatically represented in FIG. 4. It will be recalled that such a suction cup comprises a slight cavity 66 positioned opposite the material to be attracted and around which come out divergent conduits 67 in which an air flow is made to pass. This latter creates a low pressure in cavity 66 which therefore attracts strip tail 13*a* without this attraction causing friction because of the flow of air around said cavity.

The machine just described functions in the following very simple way. At the end of coiling operation, the operator controls the operation of jack 34 so that roller 29 comes in turning contact with coils 30 (assuming that coiling is done after a splitting) formed side by side on shaft 10. From this moment, all the operations are automatically linked. When a strip tail 13*a* reaches a corresponding coil 30, it is possibly drawn by attraction means 65 to trigger detector 58 which drives both oil scraper 55 and movement of roller 39 until the latter rests against the drive roller 38. Adhesive strip 28*a* is thus pinched between the rollers and is driven in the direction of pressing roller 29. This latter applies the adhesive tape against the strip of material, thus immobilizing the strip tail which has triggered the cycle. Then tool 48 cuts adhesive tape 28*a* when electrovalve 51 is driven after a certain number of rotations of roller 39 driven by roller 38. Thus, all the strip tails are succesively immobilized automatically and the operator no longer has to control the withdrawal of arms 21 (jack 34) before removing the coils of coiled material.

It will be obvious to those skilled in the art that various changes may be made without departing from the scope of the invention and the invention is not to be considered limited to what is shown in the drawings and described in the specification.

What is claimed is:

1. In a machine for coiling strip material, in which several strips are coiled side by side, on a rotating shaft, a device for momentary immobilization of the strip tails, comprising:

a plurality of supports, each for carrying a roll of adhesive tape;

a pressing roller for pressing tape onto the coil of strip material;

drive and guide means connected to each said support for causing the tape to be driven and guided to said pressing roller, when in an operative position, and for releasing the tape when in a non-operative position;

cutting means mounted on each said support for automatically cutting the adhesive tape after a predetermined length of tape has been fed by said drive and guide means, each of said cutting means comprising a jack fixedly connected to said support, a cutting tool mounted on the piston of said jack, a counting unit for assigning a numerical value to the length of tape being fed by said drive and guide means, and control means for causing said jack to be actuated when said counting unit reaches a preselected numerical value;

separating means mounted on each said support for causing the tail of the strip material to separate from the wound coil;

detector means for detecting the proximity of a tail of strip material; and control means for causing said drive and guide means to assume said operative position upon detection of a tail by said detector means.

2. In a machine for coiling strip material, in which several strips are coiled side by side, on a rotating shaft, a device for momentary immobilization of the strip tails, comprising:

a plurality of supports, each for carrying a roll of adhesive tape;

a pressing roller for pressing tape onto the coil of strip material;

drive and guide means connected to each said support for causing the tape to be driven and guided to said pressing roller, when in an operative position, and for releasing the tape when in a non-operative position;

cutting means mounted on each said support for automatically cutting the adhesive tape after a predetermined length of tape has been fed by said drive and guide means;

separating means mounted on each said support for causing the tail of the strip material to separate from the wound coil, said separating means comprising a magnet or a suction cup;

detector means for detecting the proximity of a tail of strip material; and control means for causing said drive and guide means to assume said operative position upon detection of a tail by said detector means.

3. A device in accordance with claim 2 wherein each said cutting means comprises a jack fixedly connected to said support, a cutting tool mounted on the piston of said jack, a counting unit for assigning a numerical value to the length of tape being fed by said drive and guide means, and control means for causing said jack to be actuated when said counting unit reaches a preselected numerical value.

4. A device in accordance with one of claims 1, 3, or 2 wherein each said drive and guide means comprises a drive roller connected to said support, the axis of said drive roller being fixed with respect to said support, and a pinching roller mounted with respect to said support so as to be reciprocable between an operative position in contact with said drive roller and a non-operative position out of contact therewith.

5. A device in accordance with claim 4 wherein said drive and guide means further includes a jack fixedly connected to said support for causing said pinching roller to reciprocate between said operative and non-operative positions.

6. A device in accordance with claim 4 further including a drive shaft passing through all of said supports and kinetically coupled to rotate with said pressing roller, said drive shaft being fluted, each said drive roller being mounted on said common fluted drive shaft so as to be fixed thereto with respect to rotation but axially slidable thereon; and wherein said pressing roller is a single roller common to all of said supports, said roller being covered with flexible elastic material to compensate for possible differences in diameter between the strip rolls simultaneously coiled on the rotating shaft.

7. A device in accordance with claim 1 or claim 2, further including scraper means having an operative and a non-operative position for scraping oil from the strip when in the operative position thereof, wherein said control means further causes said scraper means to assume the operative position thereof upon detection of a tail by said detector means.

8. A device in accordance with claim 5 further including a drive shaft passing through all of said supports and kinetically coupled to rotate with said pressing roller, said drive shaft being fluted, each said drive roller being mounted on said common fluted drive shaft so as to be fixed thereto with respect to rotation but axially slidable thereon; and wherein said pressing roller is a single roller common to all of said supports, said roller being covered with flexible elastic material to compensate for possible differences in diameter between the strip rolls simultaneously coiled on the rotating shaft.

9. A device in accordance with claim 4, further including scraper means having an operative and a non-operative position for scraping oil from the strip when in the operative position thereof, wherein said control means further causes said scraper means to assume the operative position thereof upon detection of a tail by said detector means.

10. A device in accordance with claim 5, further including scraper means having an operative and a non-operative position for scraping oil from the strip when in the operative position thereof, wherein said control means further causes said scraper means to assume the operative position thereof upon detection of a tail by said detector means.

* * * * *